US006171513B1

(12) United States Patent
Davis et al.

(10) Patent No.: US 6,171,513 B1
(45) Date of Patent: Jan. 9, 2001

(54) CHEMICAL-MECHANICAL POLISHING SYSTEM HAVING A BI-MATERIAL WAFER BACKING FILM AND TWO-PIECE WAFER CARRIER

(75) Inventors: Kenneth Morgan Davis, Newburgh; Ralph R. Comulada, Jr., Rock Tavern; Fen Fen Jamin; Bradley Paul Jones, both of Wappingers Falls; Francis R. Krug, Highland; Michael Francis Lofaro, Marlboro, all of NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/303,471

(22) Filed: Apr. 30, 1999

(51) Int. Cl.[7] ..... B24B 1/00

(52) U.S. Cl. ..... 216/88; 438/692; 451/287; 451/288

(58) Field of Search ..... 451/287, 288, 451/388; 216/88, 89; 438/692, 693

(56) References Cited

U.S. PATENT DOCUMENTS 5,645,474 7/1997 Kubo et al. ..... 451/287
5,885,135 3/1999 Desorcie et al. ..... 451/41
5,961,375 * 10/1999 Nagahara et al. ..... 451/287

OTHER PUBLICATIONS

T. Murakami et al., "Long Run Planarity and Uniformity Performance of CMP on Single Hard Pad with Air–Backed Carrier and In–Situ Pad Profile Control," 1996 VMIC Conference, p. 413.

K. Ikenouchi et al., "Particle Reduction by Optimization of Structure in CMP Carrier," 1999 VMIC Conference, p. 271.

* cited by examiner

*Primary Examiner*—Thi Dang
(74) *Attorney, Agent, or Firm*—Jay H. Anderson

(57) ABSTRACT

A system for chemical-mechanical polishing is described which includes a wafer backing film having concentric first and second portions, and a wafer carrier having corresponding first and second portions for mounting the portions of the wafer backing film thereon. The portions of the wafer backing film are of different materials. The second portion of the wafer backing film has an annular shape and surrounds the first portion; the second portion of the wafer carrier is adjustable with respect to the first portion of the wafer carrier in a vertical direction. The second portion of the wafer backing film is less compressible than the first portion, and is adjusted in the vertical direction so that the outer edge of the wafer is substantially sealed when backside air is applied to the wafer during a film removal process.

20 Claims, 4 Drawing Sheets

CHEMICAL-MECHANICAL POLISHING SYSTEM HAVING A BI-MATERIAL WAFER BACKING FILM AND TWO-PIECE WAFER CARRIER

RELATED APPLICATION

This application is related to Application No. 09/303,470, filed the same day and assigned to the same assignee as the present application. The disclosure of this related application is incorporated herein by reference.

FIELD OF THE INVENTION

This invention relates to semiconductor processing, and more particularly to improvement of uniformity in chemical-mechanical polishing (CMP) processes.

BACKGROUND OF THE INVENTION

In the semiconductor industry, critical steps in the production of integrated circuits are the selective formation and removal of films on an underlying substrate. Chemical-mechanical polishing (CMP) is widely used to reduce the thickness and planarize the topography of films on the substrate (generally a silicon wafer).

In a typical CMP process, a film is selectively removed from a semiconductor wafer by rotating the wafer against a polishing pad (or rotating the pad against the wafer, or both) with a controlled amount of pressure in the presence of a slurry. FIG. 1 shows a conventional CMP arrangement wherein the wafer 1 is held against a polishing pad 11 using a wafer carrier 2. Wafer carrier 2, which often comprises a metal plate, is covered by a backing film 3 in contact with the backside of the wafer (that is, the side not being polished). The wafer, wafer carrier, and backing film are held in radial alignment by a retaining ring 4.

Chemical-mechanical polishing using this standard arrangement does not result in a uniform polishing rate across the wafer, and thus does not produce a planar polished surface. Both radial and non-radial variations in uniformity have been observed. A number of techniques have been employed in attempts to equalize the polishing rate at different areas of the wafer, as detailed below.

CMP tools often use vacuum or backside air pressure at the surface of the wafer carrier to hold a wafer during loading on the tool and to eject a wafer after the process is finished. This may be done by providing a porous wafer carrier plate (as described in U.S. Pat. No. 5,645,474) and pre-punching holes in the backing film. Another typical arrangement (shown in FIG. 1B) uses a wafer carrier 2 with a plenum formed therein and holes 12 aligned with holes 13 in the backing film, to conduct air to the backside of the wafer.

Another known practice is to modulate the amount of backside air pressure during the polishing process to control and improve polishing uniformity (see, for example, Murakami et al., VMIC Conference, 1996). Air pressure applied to the backside of the wafer causes the wafer to flex outward, which in turn causes the wafer center to come into closer contact with the polishing pad. Generally, additional force on the wafer at the center reduces the polishing rate near the wafer perimeter relative to that at the center, thereby improving the overall polish uniformity.

Unfortunately, the use of backside air pressure has drawbacks. If the air is permitted to leak around the edge of the wafer, a substantial portion of the applied force is lost. In addition, greater and greater amounts of backside air pressure are required as various tool elements (such as the polishing pad and backing film) degrade with repeated use.

Furthermore, since the use of backside air pressure reduces the relative polishing rate near the wafer edge, it aggravates a well-known radial non-uniformity called "edge bead." FIG. 2 shows the radial variation in polishing rate on a 200 mm wafer in a typical CMP process. The polishing rate is generally higher near the periphery of the wafer than near the center, but drops sharply at a radius of 90–98 mm. This results in a sharp increase in film thickness (a bead) at the edge of the wafer after polishing. It is generally accepted that the edge bead is caused by deflection of the polishing pad as it meets the wafer edge; this is referred to as "pad dive." As the pad moves under the wafer and wafer carrier, the wafer edge forces the pad to tilt locally. The pad pressure on the wafer is very high at the outer 2 mm of the wafer, but very low at a radial distance of 3 to 7 mm from the edge. This low pressure results in a low polish rate. This problem is aggravated by the use of a stacked pad arrangement (preferred for many processes for better overall planarization), wherein a hard polishing pad is in contact with the wafer and a soft pad is placed underneath.

Various tool modifications have been suggested to reduce the effect of pad dive. These include milling the carrier face to a predetermined concave profile (so that the perimeter of the carrier is in closer contact with the wafer) and placing shims behind the backing film in the 90–98 mm radius area. However, even if the effects of backside air pressure and pad dive are brought into balance, that balance cannot be maintained for repeated process cycles as various components of the polishing apparatus are subjected to wear.

An additional problem that appears at the wafer edge is called "slurry penetration." If the wafer is not sealed to the wafer carrier at its edge, slurry may penetrate between the wafer edge and the retaining ring and deposit on the backside of the wafer near the edge. A cleaning process is then required after the CMP process to remove the deposited slurry. This problem is aggravated by backside air leaking radially outward, which dries the slurry and causes it to adhere to the wafer (as noted by Ikenouchi et al., CMP-MIC Conference, 1999).

There remains a need for a wafer carrier and wafer backing film arrangement which provides improved polishing uniformity and is simple and inexpensive to implement on a wide variety of tools.

SUMMARY OF THE INVENTION

The present invention addresses the above-described need for improved CMP process uniformity by providing a bi-material wafer backing film and a two-piece wafer carrier, with a wafer edge sealed against backside air leakage.

In accordance with the present invention, a film removal apparatus is provided which includes a wafer backing film having a first portion and a second portion composed of different materials. The wafer backing film is substantially circular in shape and the first portion and second portion are concentric; the first portion has a circular shape at the center of the backing film and the second portion has an annular shape and surrounds the first portion. The apparatus also includes a wafer carrier having first and second portions; the respective portions of the wafer backing film are mounted thereon. The second portion of the wafer carrier is adjustable with respect to the first portion of the wafer carrier in a vertical direction.

During a film removal process, the wafer is pressed by the wafer carrier and wafer backing film with greater pressure at the perimeter of the wafer than at its center.

According to a further aspect of the invention, the second portion of the wafer carrier is adjusted in the vertical direction so that, during a film removal process, the wafer is in contact with the second portion of the wafer backing film. Furthermore, the second portion of the wafer backing film is substantially impermeable to air. When the wafer carrier is adjusted as described just above, this permits a seal to be formed at the edge of the wafer during a film removal process. Accordingly, when backside air pressure is applied to the wafer, leakage of the air around the edge of the wafer is controlled.

DETAILED DESCRIPTION OF THE PREFERRED EMBODIMENTS

A preferred embodiment of the present invention includes a wafer backing film with an inner portion and an outer portion having different properties, where the outer portion of the backing film seals the edge of the wafer against backside air leakage. The preferred embodiment also includes a two-piece wafer carrier, corresponding to the two pieces of the backing film.

Bi-material Backing Film

Figure 1A:
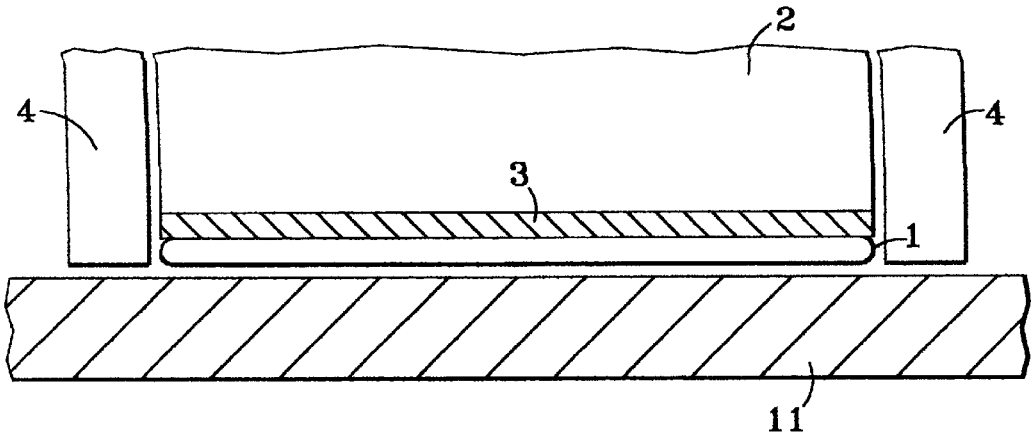
FIG. 1A PRIOR ART
FIG. 1A shows a polishing pad, wafer carrier and wafer backing film in a conventional chemical-mechanical polishing (CMP) arrangement.
Figure 1B:
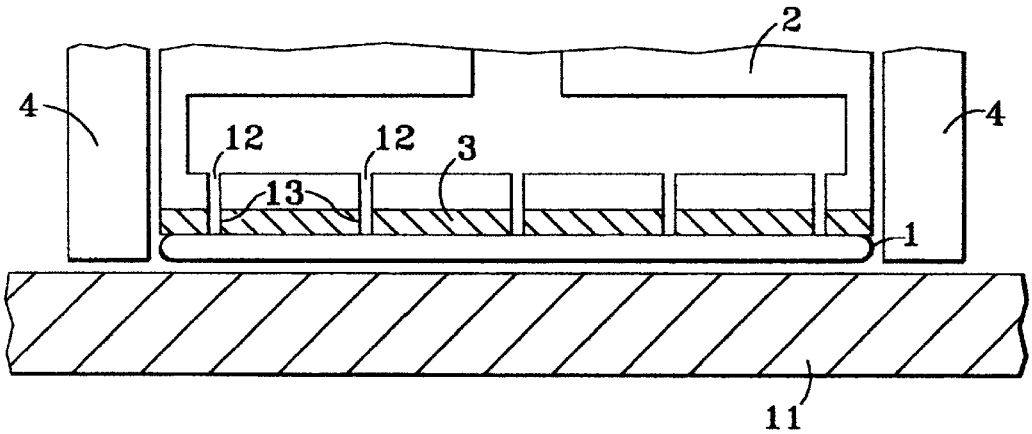
FIG. 1B PRIOR ART
FIG. 1B shows a typical chemical-mechanical polishing (CMP) arrangement in which backside air is used.
Figure 2:
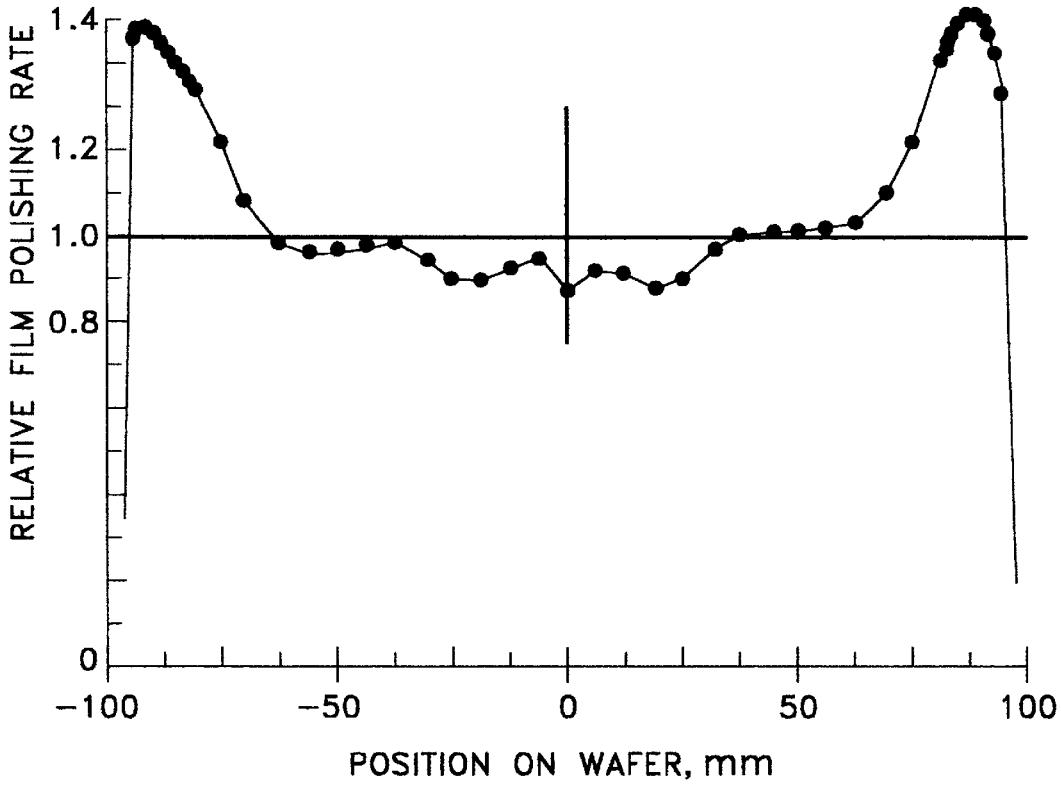
FIG. 2 PRIOR ART
FIG. 2 is a plot of radial variation of film polishing rate, showing the edge bead effect in a typical CMP process.
Figure 3:
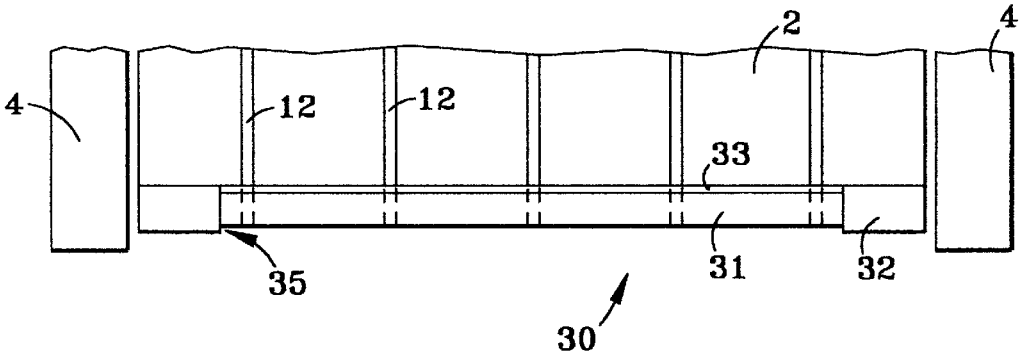
FIG. 3 shows a bi-material wafer backing film in accordance with the present invention.

The uniformity of a film polishing process may be improved by replacing the single-piece wafer backing film 3 with a bi-material backing film 30, as shown schematically in FIG. 3. In order to show details of the backing film and wafer carrier more clearly, the wafer and polishing pad are not shown in the figure.

The backing film 30 includes two concentric pieces, a center piece 31 and an outer ring 32. These pieces in general have different compressibilities, hardnesses, porosities and thicknesses. The outer diameter of ring 32 matches the diameter of the wafer being polished (e.g., 200 mm for a standard production Si wafer). In a CMP arrangement for 200 mm wafers, the outer ring 32 has a width of about 5 mm, so that the center piece 31 has a diameter of about 190 mm. The combination of two pieces 31 and 32 overcomes the problems of backside air leakage and pad dive, permitting substantial improvement in CMP process uniformity.

The center piece 31 is made from a relatively soft, compressible, gas-permeable material, such as Rodel DF200. This material may have a fibrous or open-cell structure. Center piece 31 may have a film (such as mylar) on the backside thereof, with an adhesive coating to permit positive attachment to the surface of the wafer carrier 2. Such a film, if not gas-permeable, must be perforated with holes to align with the holes 12 in the wafer carrier, so that backside air can penetrate the gas-permeable material. The thickness of center piece 31 is typically about 0.025 inch.

If the center piece is substantially thinner than the outer ring 32, a backing shim 33 may be placed behind the center piece 31. If the backing shim 33 is made of a gas-impermeable material such as mylar, it must have holes punched therein, aligned with holes 12, to permit air to reach center piece 31. In this embodiment, the thickness of the backing shim is about 0.005 inch. As shown in FIG. 3, the thickness of outer ring 32 exceeds the combined thickness of center piece 31 and backing shim 33, so that there is a step 35 between the center and outer pieces of the backing film 30.

The outer ring 32 is made from an elastic material which is harder and less compressible than that used for the center piece 31. For example, the outer ring 32 may be made from Rogers Poron 4701-50, with a compressibility about half that of Rodel DF200. This material has a closed-cell structure that is relatively impermeable to air. The thickness of the outer ring is typically about 0.031 inch in this embodiment.

When a wafer is pressed against the polishing pad by the wafer carrier during a CMP process, both the center piece 31 and the outer ring 32 are compressed. The lower compressibility of outer ring 32 results in greater polishing pressure near the wafer edge, thereby increasing the polishing rate and counteracting the edge bead effect.

Wafer Edge Seal

Figure 4:
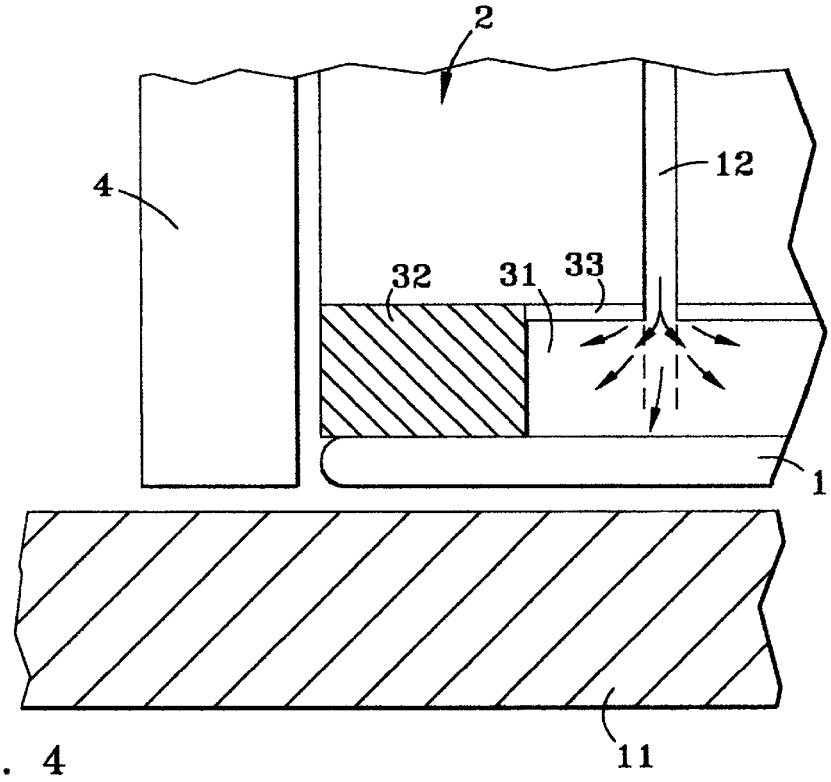
FIG. 4 is a detail view showing the wafer edge sealing effect of the bi-material backing film of the present invention.

As shown in FIG. 3, backside air is introduced behind the wafer through holes 12 in wafer carrier 2. Since the center piece 31 of the backing film 30 is gas-permeable (and any gas-impermeable film on the backside thereof is perforated), the backside air penetrates center piece 31 so that backside air pressure is distributed over the area of center piece 31. However, there are no holes 12 to apply backside air pressure behind outer ring 32, and outer ring 32 is relatively gas-impermeable. Accordingly, when the wafer 1 is pressed against the backing film 30 during polishing, the edge of the wafer is effectively clamped against outer ring 32, so that the escape of backside air between the wafer 1 and wafer carrier 2 is hindered (see FIG. 4).

It should be noted that in the present invention, the elastic outer ring 32 conforms to the backside of the wafer's outer edge when backside air pressure is applied. This is in contrast to the conventional arrangement, wherein radially leaking backside air tends to move the entire wafer in a vertical direction away from the face of the wafer carrier. When the outer edge of the wafer is sealed or partially sealed against the wafer carrier by the outer ring 32 during polishing, the flexure of the wafer tends to be a radially symmetric bowing of the wafer. Because the backside air is substantially trapped between the wafer and wafer carrier, the air pressure is uniformly distributed across the wafer backside, thereby improving polishing uniformity. Furthermore, the outer edge of the wafer is securely supported while backside air pressure is applied to the center region of the wafer. The combination of (1) control of backside air leakage and (2) mechanical support of the outer edge of the wafer permits improved control of polishing pressure on the wafer by modulating the backside air pressure. In particular, the backside air pressure at the center of the wafer may be adjusted to balance the mechanical pressure of the seal near the outer edge of the wafer, to obtain a uniform polishing rate across the wafer.

The tightness of the seal may be varied by varying the choice of material for the outer backing film piece 32 and/or the wafer carrier.

It is also noteworthy that the outer diameter of outer ring 32 is essentially the same as that of wafer 1, so that the entire back side of the wafer is covered by the backing film 30. In addition, since outer ring 32 is a relatively hard material, contaminants are prevented from penetrating the backing film and depositing on the back side of the wafer. In particular, the problem of slurry penetration is avoided.

Two-piece Wafer Carrier

Figure 5:
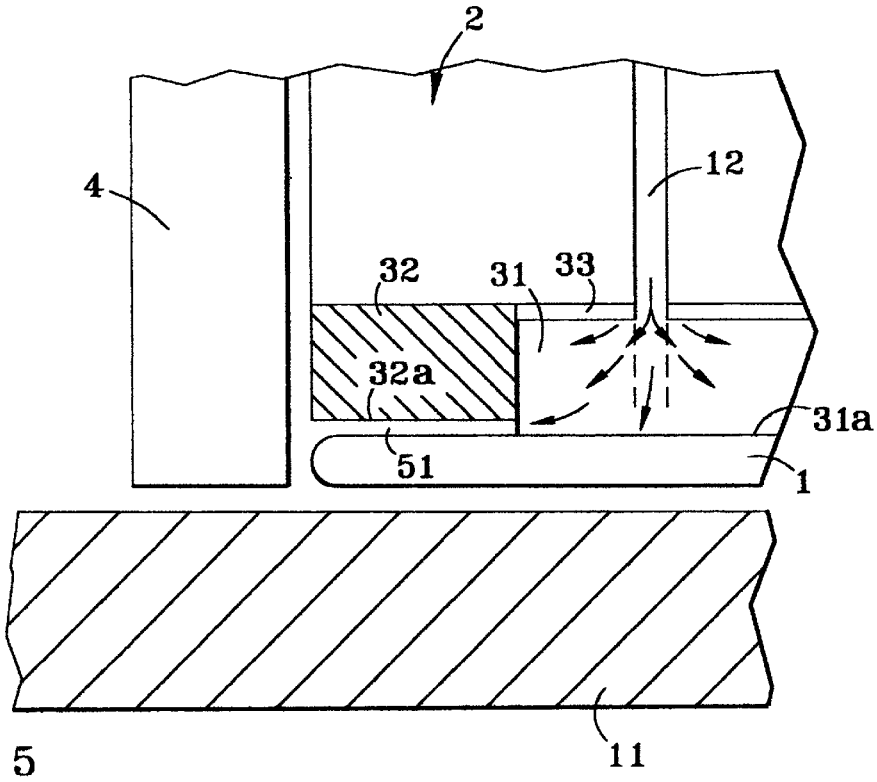
FIG. 5 is a detail view showing the effect of improper alignment of the surfaces of the two pieces of the backing film.

It has been found that the height of the step 35 between the two pieces 31, 32 of the backing film 30 has a critical effect on the uniformity of the polishing process. In particular, as both pieces are compressed during the polishing process, the vertical alignment of the two pieces 31, 32 must be such that outer ring 32 remains in contact with the backside of the wafer. FIG. 5 shows a situation where the surface 31*a* of center piece 31, when compressed during polishing and when backside air pressure is applied, is not in vertical alignment with the surface 32*a* of outer ring 32. A gap 51 appears between the wafer 1 and the outer ring 32. This results in inadequate polishing pressure on the wafer at the outer edge, and permits backside air to leak radially outward. The beneficial effects of the bi-material backing film are therefore lost.

Figure 6:
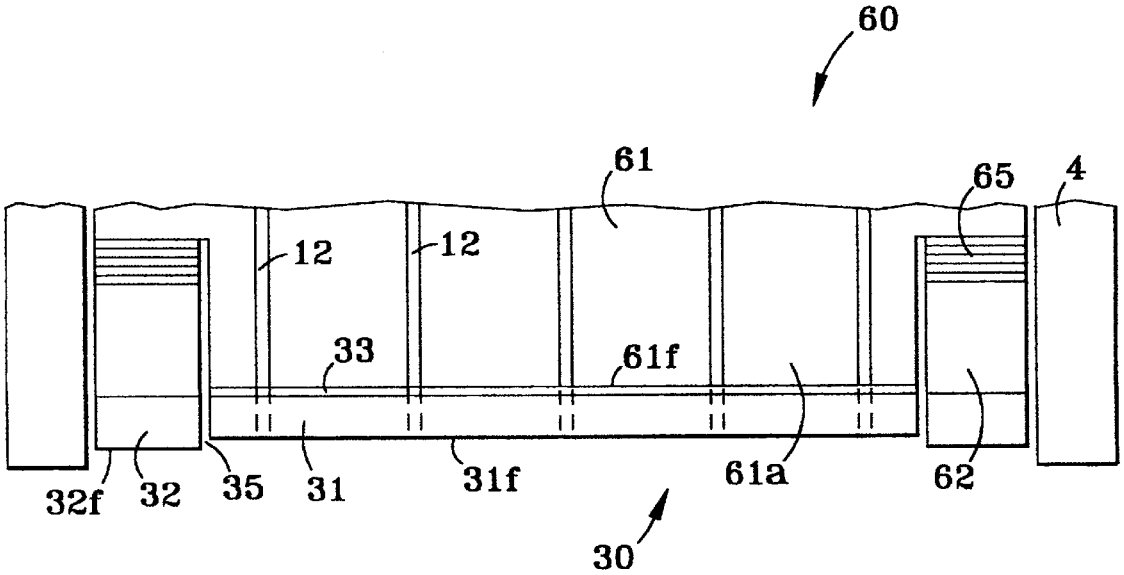
FIG. 6 shows a two-piece wafer carrier used in conjunction with a bi-material backing film, in accordance with a preferred embodiment of the present invention.

It has been found that a two-piece wafer carrier, with an outer piece thereof shimmed relative to a central piece, permits reliable control of the step height. This arrangement is shown schematically in FIG. 6. The wafer carrier 60, whose overall outside diameter matches that of the wafer, includes a central piece 61 and an outer piece 62. Comparing wafer carrier 60 with a conventional one-piece wafer carrier 2, it can be seen that outer piece 62 is essentially a ring which fits into a step machined into the outer portion of piece 61. The central piece 61 and outer piece 62 may be made of the same material (typically stainless steel) or of different materials.

In this arrangement, the step height 35 may be characterized as the vertical distance between surfaces 31*f* and 32*f* of the center piece 31 and outer ring 32 of the wafer backing film 30 (that is, the surfaces facing the wafer during a polishing process). A positive value of step height 35 is defined as surface 32*f* being at a greater vertical distance, relative to surface 61*f* of the central piece 61 of the wafer carrier, than surface 31*f*. The optimum step height will depend upon the materials and dimensions chosen for the center piece 31 and the outer ring 32. When the center piece 31 and outer ring 32 are of the materials and dimensions given above, the optimum height of step 35 has been found to be 0.001 inch.

The two wafer carrier pieces 61, 62 have radial dimensions matching the inner and outer backing film pieces 31, 32 respectively. Thus, in an arrangement for polishing a 200 mm wafer, the ring-shaped outer piece 62 may have for example an inner diameter of about 190 mm and an outer diameter of 200 mm, while the stepped portion 61*a* of central piece 61 has an outer diameter of about 190 mm to match the inner diameter of outer piece 62. The wafer backing pieces 31, 32 may be attached to the wafer carrier pieces 61, 62 with a suitable adhesive. When the wafer carrier is assembled, outer piece 62 fits closely around central piece 61, so that the wafer backing film pieces 31, 32 likewise fit closely together to present a continuous surface to the wafer.

The height of the step 35 between the center and outer pieces 31, 32 of backing film 30 is controlled by placing shims 65 under the outer wafer carrier piece 62. If an adjustment in the step height is necessary, outer piece 62 is demounted and shims 65 are added or removed. It should be noted that to adjust the height, it is not necessary to remove either of the backing film pieces from their respective wafer carrier pieces.

Since the radial dimensions of the wafer carrier pieces match those of the backing film pieces, the backing film pieces 31, 32 are self-aligned to wafer carrier pieces 61, 62. This assures an accurate fit between backing film pieces 31 and 32 when the wafer carrier is assembled. Each of the two backing film pieces 31, 32 may be independently mounted on its wafer carrier piece, thereby simplifying the assembly process. Furthermore, adjustment of the step height 35, by placement and removal of shims 65, permits use of varying thicknesses of both backing film pieces. The thicknesses of backing film pieces 31, 32 may be varied to optimize the polishing process, without the need for modification of the wafer carrier.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A film removal apparatus in which a film is removed from a wafer, the apparatus comprising:

a wafer backing film having a first portion and a second portion composed of different materials, said wafer backing film being substantially circular in shape and the first portion and the second portion being concentric, the first portion having a circular shape at the center of said backing film and the second portion having an annular shape and surrounding the first portion; and a wafer carrier having a first portion for mounting the first portion of said wafer backing film thereon and a second portion for mounting the second portion of said wafer backing film thereon, the second portion of the wafer carrier having an annular shape and surrounding the first portion of the wafer carrier, wherein the second portion of the wafer carrier is adjustable with respect to the first portion of the wafer carrier in a vertical direction.

2. An apparatus according to claim 1, wherein during a film removal process the wafer is pressed by said wafer carrier and said wafer backing film with greater pressure at the perimeter of the wafer than at the center of the wafer.

3. An apparatus according to claim 1, wherein the second portion of the wafer carrier is adjusted in the vertical direction so that, during a film removal process, the wafer is in contact with the second portion of the wafer backing film.

4. An apparatus according to claim 3, wherein the second portion of said wafer backing film is substantially impermeable to air, thereby controlling air leakage when air pressure is applied to a back surface of the wafer.

5. An apparatus according to claim 4, wherein the first portion of the wafer backing film is permeable to air.

6. An apparatus according to claim 1, wherein the first portion of the wafer carrier has a surface on which the first portion of the wafer backing film is mounted and which is substantially coextensive with the first portion of the wafer backing film, and the second portion of the wafer carrier has a surface on which the second portion of the wafer backing film is mounted and which is substantially coextensive with the second portion of the wafer backing film.

7. An apparatus according to claim 6, wherein the second portion of the wafer backing film and the second portion of the wafer carrier each have an outer diameter substantially identical to the diameter of the wafer.

8. An apparatus according to claim 7, wherein the wafer has a diameter of 200 mm, the first portion of the wafer backing film and the first portion of the wafer carrier each have a diameter greater than 170 mm, and accordingly the second portion of the wafer backing film and the second portion of the wafer carrier each have an inner diameter greater than 170 mm.

9. An apparatus according to claim 8, wherein the first portion of the wafer backing film and the first portion of the wafer carrier each have a diameter of about 190 mm, and accordingly the second portion of the wafer backing film and the second portion of the wafer carrier each have an inner diameter of about 190 mm.

10. A film removal apparatus in which a film is removed from a wafer, the apparatus comprising:

a wafer backing film having a plurality of portions composed of different materials, said wafer backing film being substantially circular in shape and the portions being concentric, the portions including a center portion having a circular shape at the center of said backing film and an outer portion having an annular shape; and a wafer carrier having a plurality of portions for mounting the respective portions of said wafer backing film thereon, the portions of the wafer carrier including an annular outer portion on which the outer portion of the wafer backing film is mounted, wherein the outer portion of the wafer carrier is adjustable with respect to the other portions of the wafer carrier in a vertical direction.

11. A method for removing a film from a wafer, the method comprising the steps of:

providing a wafer backing film having a first portion and a second portion composed of different materials, said wafer backing film being substantially circular in shape and the first portion and the second portion being concentric, the first portion having a circular shape at the center of said backing film and the second portion having an annular shape for surrounding the first portion;

providing a wafer carrier having a first portion for mounting the first portion of said wafer backing film thereon and a second portion for mounting the second portion of said wafer backing film thereon, the second portion of the wafer carrier having an annular shape for surrounding the first portion of the wafer carrier;

mounting the first portion of the wafer backing film on the first portion of the wafer carrier;

mounting the second portion of the wafer backing film on the second portion of the wafer carrier;

assembling the wafer carrier by fitting the second portion of the wafer carrier around the first portion thereof; and adjusting the second portion of the wafer carrier with respect to the first portion of the wafer carrier in a vertical direction.

12. A method according to claim 11, further comprising the step of pressing the wafer by said wafer carrier and said wafer backing film with greater pressure at the perimeter of the wafer than at the center of the wafer.

13. A method according to claim 11, wherein the second portion of the wafer carrier is adjusted in said adjusting step so that, during a film removal process, the wafer is in contact with the second portion of the wafer backing film.

14. A method according to claim 13, wherein the second portion of said wafer backing film is substantially impermeable to air, thereby substantially preventing air leakage when air pressure is applied to a back surface of the wafer.

15. A method according to claim 14, wherein the first portion of the wafer backing film is permeable to air.

16. A method according to claim 11, wherein the first portion of the wafer carrier has a surface on which the first portion of the wafer backing film is mounted and which is substantially coextensive with the first portion of the wafer backing film, and the second portion of the wafer carrier has a surface on which the second portion of the wafer backing film is mounted and which is substantially coextensive with the second portion of the wafer backing film.

17. A method according to claim 16, wherein the second portion of the wafer backing film and the second portion of the wafer carrier each have an outer diameter substantially identical to the diameter of the wafer.

18. A method according to claim 17, wherein the wafer has a diameter of 200 mm, the first portion of the wafer backing film and the first portion of the wafer carrier each have a diameter greater than 170 mm, and accordingly the second portion of the wafer backing film and the second portion of the wafer carrier each have an inner diameter greater than 170 mm.

19. A method according to claim 18, wherein the first portion of the wafer backing film and the first portion of the wafer carrier each have a diameter of about 190 mm, and accordingly the second portion of the wafer backing film and the second portion of the wafer carrier each have an inner diameter of about 190 mm.

20. A method for removing a film from a wafer, the method comprising the steps of:

providing a wafer backing film having a plurality of portions composed of different materials, said wafer backing film being substantially circular in shape and the portions being concentric, the portions including a center portion having a circular shape at the center of said backing film and an outer portion having an annular shape;

providing a wafer carrier having a plurality of portions for mounting the respective portions of said wafer backing film thereon, the portions of the wafer carrier including an annular outer portion on which the outer portion of the wafer backing film is mounted;

mounting the portions of the wafer backing film on the respective portions of the wafer carrier;

assembling the wafer carrier by fitting the outer portion of the wafer carrier around the other portions thereof; and adjusting the outer portion of the wafer carrier with respect to the other portions portion of the wafer carrier in a vertical direction.

* * * * *